US006000966A

United States Patent [19]

Dechanteloup et al.

[11] Patent Number: 6,000,966

[45] Date of Patent: Dec. 14, 1999

[54] ELECTRICAL CONNECTOR WITH CONTACT TERMINAL LOCKING

[76] Inventors: Jean-Michel Dechanteloup, 82, rue Gazonfier, 72000 Le Mans; Jean-Max Badeau, 32, Allee des Marronniers, 72450 Montfort le Genois; Jean Raoelison, 32 rue de Budapest; Patrick Sangleboeuf, 32, Avenue du Marechal Lyautey, both of 72000 Le Mans, all of France

[21] Appl. No.: 08/079,279

[22] Filed: Jun. 21, 1993

[30] Foreign Application Priority Data

Jun. 22, 1992 [FR] France ..... 92 07584

[51] Int. Cl.[6] ..... H01R 13/40

[52] U.S. Cl. ..... 439/595

[58] Field of Search ..... 439/586–603

[56] References Cited

U.S. PATENT DOCUMENTS

| | | | |
|---|---|---|---|
| 3,477,061 | 11/1969 | Stephenson | 439/595 |
| 3,638,165 | 1/1972 | Anhalt et al. . | |
| 4,386,816 | 6/1983 | Frear et al. | 439/595 |
| 4,406,507 | 9/1983 | Eifler | 439/595 |
| 4,544,220 | 10/1985 | Aiello et al. | 439/595 |
| 4,684,187 | 8/1987 | Rudy et al. . | |
| 4,758,182 | 7/1988 | Anbo et al. | 439/586 |

FOREIGN PATENT DOCUMENTS

| | | |
|---|---|---|
| 0147956 | 7/1985 | European Pat. Off. . |
| 2626720 | 8/1989 | France . |
| 9014856 | 2/1991 | Germany . |
| 4010440 | 10/1991 | Germany . |
| 965353 | 7/1964 | United Kingdom . |

*Primary Examiner*—Steven C. Bishop

[57] ABSTRACT

An electrical connector comprises an insulating housing having a transversal partition formed with mutually parallel passages for receiving electrical terminals, and a retention plate insertable into the housing up to a front position in which it is retained against the partition. The plate is formed with terminal-receiving holes distributed in the same array as the passages. They extend forwardly as resilient fingers adapted for snap-fastening connection with the terminals. The fingers are adapted to the shape of the passages so that they can penetrate into a passage and be retained therein in the position where they hold the terminals when the retention plate is in its front position. Each hole is formed with a rearwardly-directed shoulder for abutment with a corresponding step on the respective terminal. The abutment shoulder is placed so as to stop the terminal in the position where the fingers are snapped onto them.

9 Claims, 2 Drawing Sheets

ELECTRICAL CONNECTOR WITH CONTACT TERMINAL LOCKING

BACKGROUND OF THE INVENTION

The present invention relates to electrical connectors of the type comprising an insulating housing formed with mutually parallel passages for receiving electrical terminals, and a retention plate insertable in the housing up to a forward position in which it is retained, the plate being formed with terminal-receiving holes that are distributed in an array corresponding to the array of the passages and that are extended forwardly by resilient fingers for retaining terminals by snap-fastening, the fingers having a shape complementary to the shape of the passages so as to enable them to penetrate into the passages and be retained therein in the position where they hold the terminals when the retaining plate is in its front position. A description of a connector of this kind can be found in FR-A-2626720.

Connectors of the above type are in very wide use, either with rectangular housings containing terminals distributed in a rectangular array or in a quincunx array, or with so-called "round" housings. Such connectors may be relatively simple in structure and they make high terminal distribution densities possible.

However, present connectors of the above type suffer from drawbacks. Either the retention plate retains the terminals in one direction only (retention in the opposite direction being provided by separate means), or else retention is only by the resilient fingers. The first solution makes implementation more complicated. The second makes it difficult to retain the terminals securely in an accurate longitudinal position.

SUMMARY OF THE INVENTION

It is an object of the present invention to provide an electrical connector of the type defined above and achieving retention of the contact terminals in a manner that is effective, accurate and nevertheless very simple.

To this end, the invention provides, in particular, a connector in which each of the holes is formed with a rearwardly-directed shoulder for abutment with a corresponding step formed on the respective terminal, the abutment shoulder being placed so as to stop the terminal in the position where the fingers are snapped onto it.

By virtue of this structure, the terminal retention means are located entirely on the retention plate; the passages of the housing serve only to "confirm" the snap action fastening.

When a contact distribution density that is as high as possible is desired, it is advantageous to dispose the retaining fingers for adjacent contacts at different angular locations. For example, when the terminals are distributed in a square array, it is advantageous to provide each hole with two opposing fingers, the fingers associated with a given hole being oriented at 90° relative to the fingers associated with the four adjacent holes.

For simplification purposes, the retention plate may include means for locking it directly in a forward position on the insulating housing: This avoids the need for additional locking members. Consequently, in an advantageous embodiment, the retention plate is provided with locking means that cooperate with the side wall of a cavity or chamber which is formed in the insulating housing and receives the plate. These means make it possible to prevent the plate from moving backwards relative to the housing from its forward position, in which the plate bears against a transverse partition that may be considered as constituting an end wall of the housing.

The locking means may include a circumferential section of a rear skirt of the plate, which section is defined by slots that extend parallel to the insertion direction, and is provided with a locking stud for engaging in a circumferential groove of the housing. The section may also include a catch for temporarily retaining the plate in a partially withdrawn position in which the terminals can be inserted or withdrawn by overcoming the resilient force exerted by the retaining fingers. This avoids untimely mutual separation of the components of the connector.

Most existing connectors require tooling to be used for disassembling a connector and removing one or more terminals.

In an advantageous embodiment of the invention, the connector is made suitable for disassembling without using a tool. For this purpose, the above-mentioned circumferential section includes a circumferentially offset portion of the catch and of the stud, and the wall of the housing is formed with a notch through which the offset portion can pass, thereby making it possible for an operator to use his finger to exert an inwardly directed bending force beneath that portion.

BRIEF DESCRIPTION OF THE DRAWINGS

The invention will be better understood on reading the following description of a particular embodiment given by way of example. The description refers to the accompanying drawings.

DETAILED DESCRIPTION

Figure 2:
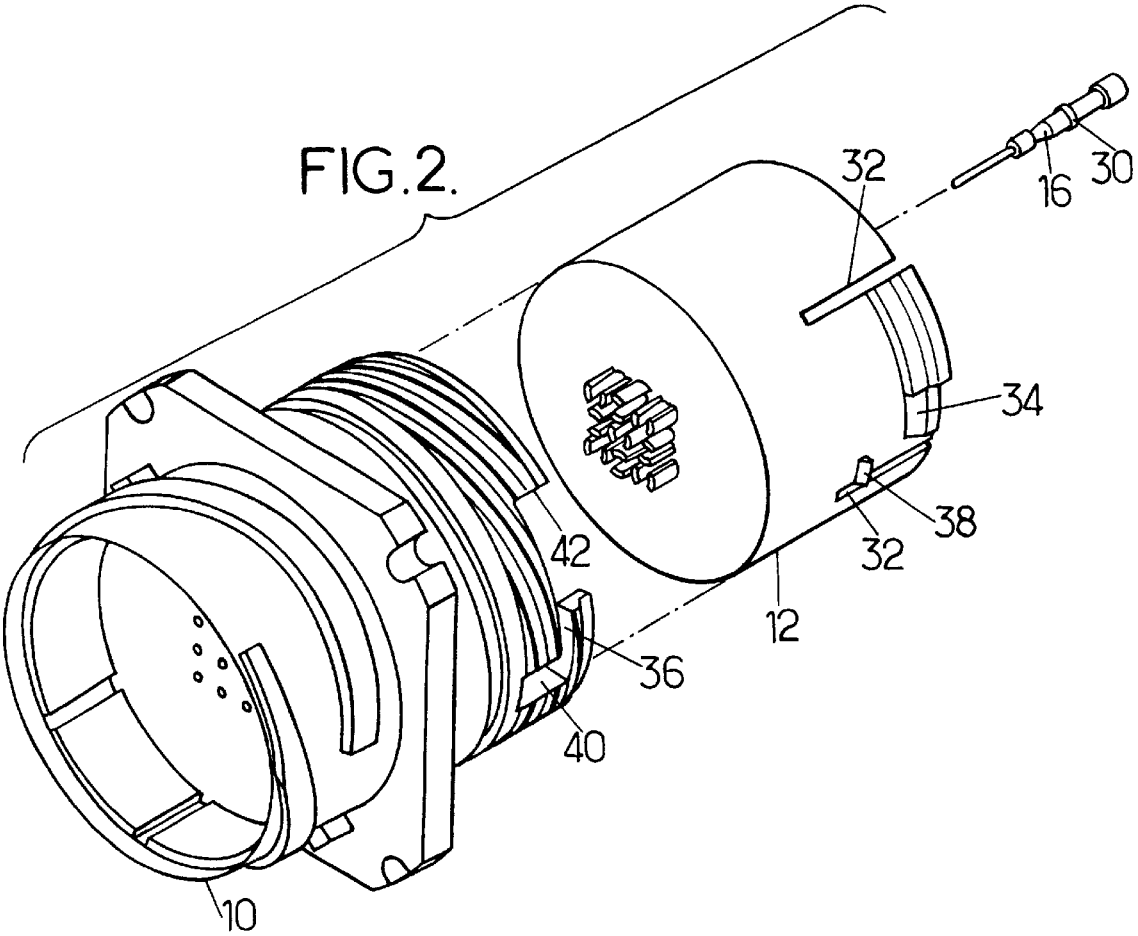
FIG. 2 is an exploded view of the FIG. 1 receptacle.
Figure 1:
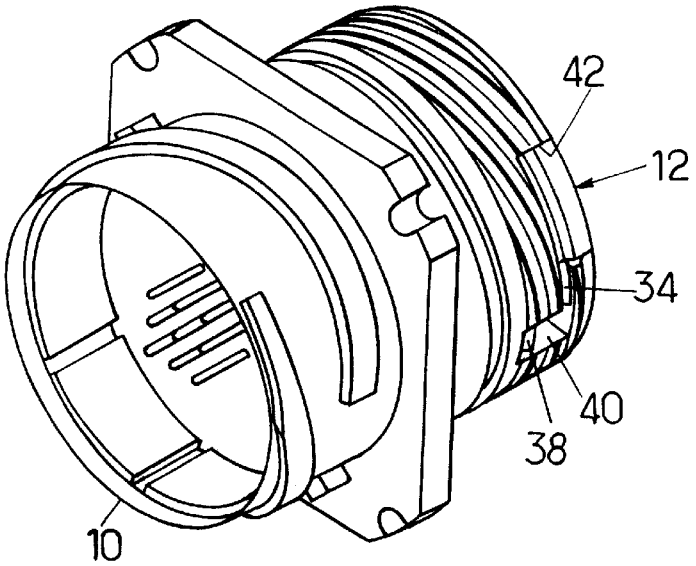
FIG. 1 is a perspective view of a receptacle or female connector constituting a particular embodiment of the invention.

The connector shown schematically is a receptacle whose contact terminals are constituted by pins distributed in a square array. The invention is nevertheless also applicable to a plug and/or to a connector provided with terminals constituted by sockets. Although the invention is particularly advantageous when the terminals are made by machining, it is also applicable to terminals made by cutting out and rolling up metal sheet.

The connector comprises a housing 10 and a retention plate 12, both made of insulating material, e.g., thermoplastic or thermosetting material reinforced by a filler, such as fiber glass.

The housing 10 as shown may be considered as having a partition 14 that is formed with terminal-receiving passages (only one terminal 16 being shown in FIGS. 3 and 4), and by a rear sidewall 18 that defines a cavity for receiving the retention plate 12. Since the connector is a receptacle, it also has a front sleeve 20 carrying means for fastening to a complementary connector and constituted, as shown, by a thread. In the partition 14 which constitutes an end wall, there are formed evenly distributed passages for receiving the shanks of the terminals.

The retention plate 12 comprises a rear skirt 24 and a disk-shaped solid portion 22 to be forcibly applied against the partition 14 of the housing.

The solid portion 22 is formed with terminal-receiving holes 25 having the same distribution as the passages. Each hole has a rearwardly directed shoulder 26 that is designed to constitute an abutment for the corresponding terminal.

Beyond its solid portion 22, the plate is extended by two sets of locking fingers 28 that are thick at their free ends and have a resiliency that tends to give them a shape in which their ends, constituting snap-action tips, define a sectional area that is smaller than the cross-section of the terminal shanks. Each set generally comprises two diametrically opposed fingers 28. To make a high distribution density of holes and terminals possible, the two fingers associated with a given hole are generally at 90° relative to the fingers associated with the adjacent holes, if the array is square or rectangular.

Each terminal 16 comprises a radial step which, in the example shown, is formed by a forwardly-facing flank of a flange 30. The portion of the terminal shank located forwardly of the collar has a smaller diameter, small enough to enable the terminal to be inserted beyond the shoulder 26 of the hole. Each terminal also includes a V-shaped groove for snap-action engagement with the tips of the fingers 28. The front wall of the groove constitutes a latching shoulder for the tips of the fingers 28. The distance between the shoulder and the step corresponds to the distance between the shoulder of the hole and the location of the tips.

The retention plate 12 is provided with locking means that cooperate with the side wall 18 of the housing. These means comprise a circumferential section of the rear skirt, defined by slots 32 that are parallel to the insertion direction. The section includes a stud 34 for snap-fastening engagement into a circumferential groove 36 of the housing (FIG. 2).

The section also comprises a catch 38 which is slidably received and retained in a longitudinal opening 40 in the housing. The longitudinal length of the opening is such that the catch can move freely between a rear position (FIG. 3) in which it retains the plate in a position in which the locking fingers are free, thus enabling terminals to be inserted and removed, and a forward position in which the plate is in contact with the transverse housing partition 14. To enable the plate 12 to be withdrawn to the position shown in FIG. 3, or to enable it to be withdrawn completely without a tool, the housing is typically designed to enable an operator to bend the section carrying the catch 38 and the stud 34 with a finger. For this purpose, a rear notch 42 is formed in the sidewall 18. This makes it possible to press a finger against a fraction of the section which may be provided with a flange.

Figure 3:
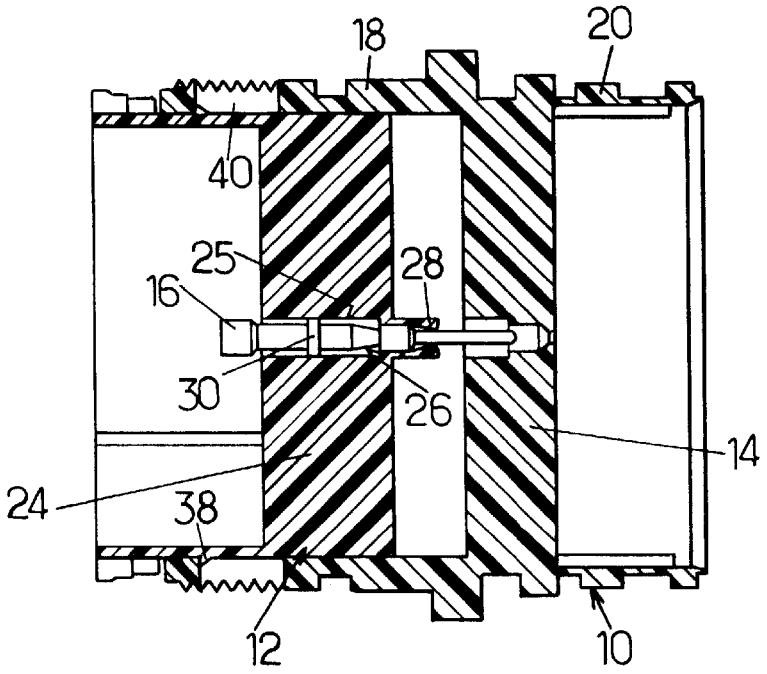
FIG. 3 is a cross-sectional view of the receptacle of FIG. 1 along a plane that includes the axis thereof and that also includes the temporary retention catch, the plate being shown partially inserted.
Figure 4:
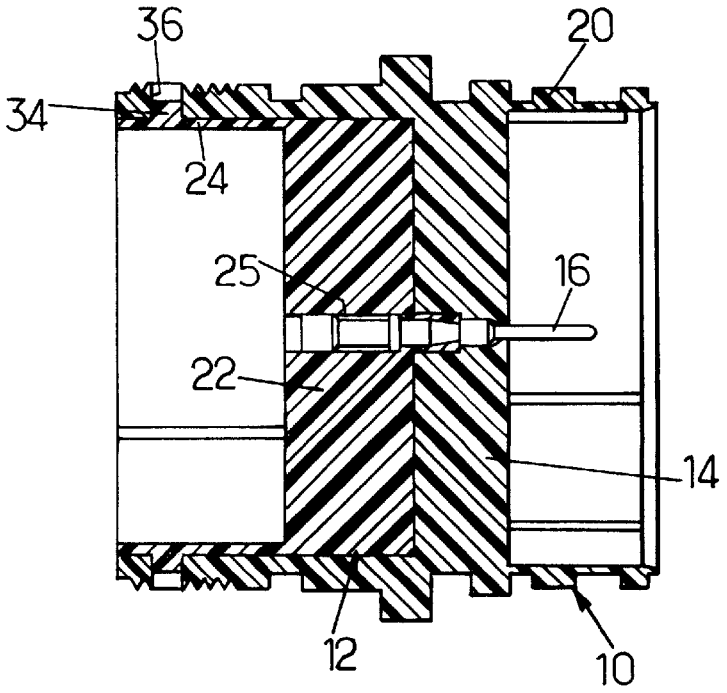
FIG. 4 is a cross-sectional view of the receptacle on a plane including its axis and also including the locking stud, the plate being in its front position.

Instead of a single locking section, a plurality of uniformly distributed sections will normally be provided. FIGS. 3 and 4 show two diametrically opposite sections, thereby facilitating disengagement by forcing the sections radially towards each other between two fingers.

The way in which terminals are installed while the housing and the retention plate are in the position shown in FIG. 3, and in which the connector is then assembled by pushing the retention plate to the position shown in FIG. 4, can clearly be understood from the above description, so there is no need to list the necessary steps in detail. The connector is frequently completely by sliding a grommet of flexible material into the skirt of the plate and by locking it in place with a cap, e.g., a cap that is screwed onto a thread on the sidewall 18 of the housing.

We claim:

1. Electrical connector comprising:

(a) a housing of electrically insulating material having a transverse partition formed with a plurality of mutually parallel passages distributed in a regular array, and having means for connection with a mating connector;

(b) a plurality of electrical terminals for insertion into said mutually parallel passages; and (c) a retention plate removably insertable into said housing up to a forward position in which said retention plate is in contact with said partition, said plate being formed with terminal-receiving holes distributed in an array identical to the array of said passages;

(d) wherein each said hole has a rearwardly-directed shoulder for abutting connection with a respective step formed on one of said electrical terminals received in said hole for preventing further forward movement of said terminal, and wherein said retention plate is forwardly extended by resilient fingers having a shape matching that of said passages to enable said fingers to be received in said passages and prevented by said passages from spreading apart from a position in which they prevent withdrawal of said terminals when said retention plate is in said forward position.

2. Connector according to claim 1, wherein each said hole has a plurality of said fingers which are angularly distributed, the fingers associated with one of said holes being in an angular position with respect to an axis of said hole which is different from the angular positions of fingers of all adjacent ones of said holes.

3. Connector according to claim 2, wherein said holes are distributed in a square or rectangular array and each said hole has two said fingers, the two fingers of one of said holes being at 90° from the fingers of adjacent ones of said holes.

4. Connector according to claim 1, wherein each said terminal has an electric contact zone and, rearwardly of said zone, a shank formed with a rearwardly directed shoulder for abutting connection with tips of said fingers and with a flange having a diameter greater than that of a portion of the terminal which is located forwardly thereof, said flange having a forwardly directed flank which constitutes said step.

5. Connector according to claim 1, wherein said retention plate is provided with means for locking it on a lateral wall of a cavity formed in said housing for receiving said retention plate, said locking means being so formed as to prevent rearward movement of said retention plate with respect to said housing from said forward position of said retention plate.

6. Connector according to claim 5, wherein said locking means comprise a circumferential section of a rear skirt of said retention plate, said circumferential section being defined by slots extending parallel to an insertion direction and being provided with a locking stud for engagement into a circumferential groove of said housing.

7. Connector according to claim 6, wherein said skirt comprises a catch for temporarily retaining said retention plate in a position that is far enough back from said forward position to permit said terminals to be inserted and withdrawn merely by overcoming a resilient force exerted by said fingers.

8. Connector according to claim 7, wherein said catch is carried by said circumferential section and is received in a longitudinal opening of said housing for free axial movement between a rearward position for temporary retention and a forward position which corresponds to said forward position of said retention plate.

9. Connector according to claim 6, wherein said circumferential section includes a portion which is circumferentially offset with respect to said catch and said stud, and wherein said lateral wall comprises a notch through which the offset portion can pass, thereby making it possible for an operator to use his fingers to exert an inwardly directed bending force on said offset portion.

* * * * *